US005085366A

United States Patent [19]

Durgin et al.

[11] Patent Number: 5,085,366

[45] Date of Patent: Feb. 4, 1992

[54] HIGH GLOSS PAPER CUP

[75] Inventors: Ronald A. Durgin, Eldersburg; Derek S. Matheson, Baltimore, both of Md.; Delvin K. Border, Glen Rock, Pa.; Carlton L. Kennet, Sykesville, Md.; Daniel E. Hammett, Brodbocke, Pa.

[73] Assignee: Sweetheart Cup Company, Chicago, Ill.

[21] Appl. No.: 722,314

[22] Filed: Jun. 27, 1991

Related U.S. Application Data

[62] Division of Ser. No. 358,007, May 26, 1989, Pat. No. 5,039,560.

[51] Int. Cl.[5] ..... B65D 3/28

[52] U.S. Cl. ..... 229/1.5 B; 229/4.5

[58] Field of Search ..... 229/1.5 B, 3.1, 4.5

[56] References Cited

U.S. PATENT DOCUMENTS 2,554,662 5/1951 Cowgill ..... 229/3.1

3,137,431 6/1964 Crouse et al. ..... 229/1.5 B 3,240,611 3/1966 Williams ..... 229/3.1

3,369,932 2/1968 Sawyer, Jr. et al. ..... 229/3.1

3,450,327 6/1969 Ludder ..... 229/1.5 B

*Primary Examiner*—Gary E. Elkins

*Attorney, Agent, or Firm*—Nixon & Vanderhye

[57] ABSTRACT

A method is described for continuously producing a smooth, high gloss coating on a paper container comprising the steps of applying a substantially uniform coating of melted wax material to the outside surface of the container or sheet stock, maintaining the temperature of the wax coating above its melting point and above its congealing temperature, imparting a constant surface velocity to the outside surface of the container or sheet stock and applying a substantially uniform film of liquid coolant, particularly water, to the outside surface of the container or sheet stock whereby the surface velocity of the coolant is substantially equal to the surface velocity of the container or sheet stock.

5 Claims, 3 Drawing Sheets

$V_S = \omega r$
$V_S = V_W$
$V_S - V_W = 0$

HIGH GLOSS PAPER CUP

RELATED APPLICATIONS

The present invention is a divisional of U.S. application Ser. No. 07/358,007, filed May 26, 1988 now U.S. Pat. No. 5,039,560 issued Aug. 13, 1991.

FIELD OF THE INVENTION

The present invention relates to a method for producing a gloss finish on wax-coated products such as containers or flat sheets (webs) comprised of paper. In particular, the present invention relates to a method for continuously producing a smooth, high gloss coating on flat "sheet stock" or pre-formed containers such as drinking cups which have a coating of melted wax material applied to the surfaces thereof

BACKGROUND AND SUMMARY OF THE INVENTION

Three well known methods exist for producing a gloss surface on a waxed paper surface It has long been known to use the so-called "dip" method for producing a gloss surface on containers whereby a previously-waxed cup having a coating of hot liquid wax is immersed or "rolled" through a liquid coolant such as water to create the gloss appearance. Although this early technique could be used successfully to create a gloss surface, it has a number of disadvantages For example, the gloss using the dip method tends to be uneven and exhibits a "rippled" visual appearance. The problem becomes more severe if the wax coating itself is non-uniform, i.e., heavier on certain areas of the cup surface than others due to a non-uniform application in the wax treater or because of temperature variations of the melted wax before cooling on the cup surface.

Even if the liquid wax coating is applied in a smooth and uniform manner, the dip technique tends to cause a non-uniform cooling/crystallization of the wax due to the action of the coolant as it contacts the melted wax. One probable explanation for such non-uniformity is that the water (or other cooling medium) disturbs the surface of the liquid wax upon contact with the cup surface, thereby resulting in the uneven "rippled" appearance. In addition, any such surface imperfections tend to distort the appearance of graphics on the cup such as the design artwork or printing, making the end product commercially unacceptable.

The formation of a smooth high gloss surface on containers is made more difficult because paraffin-type waxes used on conventional cups have varying molecular weight distributions. As a general proposition, during cooling the higher fractions initially form tiny surface crystals (creating the gloss appearance) while forming a matrix to hold the remaining uncongealed liquid wax. Thus, it is important that the wax be rapidly and uniformly cooled along the entire cup surface at the same time in order to obtain a uniform formation of surface crystals. As indicated above, it is also essential that the yet unhardened wax remain undisturbed during the cooling step.

Thus, one additional problem with the conventional "dip" method is that it requires that the cooling take place within a very narrow and controlled temperature range for the congealing liquid wax (typically in the range of only 3–5 degrees Fahrenheit) in order to obtain a uniform gloss. As a result, the "dip" method poses a very significant quality control problem in any commercial application because of the narrow effective temperature range and resultant lack of operating flexibility.

A second known method for cooling previously waxed cups to create a gloss surface uses one or more streams of cooling air. Again, it is very difficult to obtain a uniform gloss surface using such techniques primarily because of the problems in maintaining a constant wax temperature during cooling along the side walls of the cup and because the low thermal conductivity of air requires a velocity and flow volume which results in disruption of the liquid wax surface in its uncongealed state more severe than that encountered with the dip method.

A third known method for producing a surface gloss uses a water spray technique which likewise cools the liquid wax as it passes through a cooling chamber. Again, however, the prior art spray techniques tend to cause surface imperfections due to the physical impact of spray droplets against the film of congealing liquid wax.

As an alternative to the traditional wax coating/cooling techniques for creating a gloss surface on paper products, cup manufacturers more recently have begun to use plastic coatings (such as polyethylene or polystyrene) to produce a uniform gloss or "glaze"-like surface on the product. Typically, such coatings are applied to both exterior and interior container surfaces. Although the so-called "double-sided poly" cups have improved the consistency and uniformity of gloss products, they have certain distinct disadvantages. For example, the plastic coating on the cups is essentially non-biodegradable and therefore presents environmental concerns as non-disposable wastes. In addition, unlike wax-coated paper products, the "double-sided poly" products cannot be recycled. They also tend to have reduced sidewall stiffness as compared to wax cups or may leak because of deficiencies in the forming and sealing process.

It has now been found that it is possible to produce a high gloss on previously waxed paper sheet stock or containers while avoiding the above problems of appearance and uniformity. It has also been found that a commercially viable replacement product for double-sided poly coated cups can be produced using a process for treating previously coated wax cups which results in a surface having equal or better characteristics of gloss, stiffness and graphic appearance.

In one preferred exemplary embodiment, the process according to the present invention uses a thin uniform film of coolant such as water which impacts a rotating cup at a specific angle of orientation when the cup is moving at a constant linear speed. The film of water "touches" (but does not disturb) the uncongealed liquid wax coating on the cup. The water is applied to the cup at a minimum (preferably zero) relative velocity, i.e., minimum relative to the rotational (angular) velocity of the cup itself, and at a position parallel to the cup side wall and tangent to the outer diameter of the cup.

In particular, it has now been found that a uniform high gloss surface can be obtained by (1) applying a substantially uniform coating of melted wax material to the outside surface of the cup; (2) maintaining the coated wax surface at a uniform temperature above the wax melting point (and therefore above the congealing temperature); (3) rotating the cup at a uniform spin rate, thereby imparting a constant angular velocity to the cup; and (4) applying a thin, substantially uniform film of cooling medium (preferably water) to the cup tangential to the rotating cup surface under laminar flow conditions, i.e., at a precisely controlled velocity, temperature and volume such that the water effectively "wraps" around the cup with minimum disturbance to the uncongealed wax. The laminar flow of water around the rotating cup actually causes the water to be drawn onto the cup surface as it turns. In the preferred embodiment of the invention, the relative velocity between the rotating cup and the applied film of water on the surface is approximately zero.

In an alternative embodiment of the present invention, it has also been found that a uniform gloss surface can be produced on a previously coated and cooled wax cup, i.e., a cup having a congealed "satin" non-gloss wax coating, by (1) reheating the previously waxed cup to a temperature above the melting point of the wax coating; (2) maintaining the coated wax surface at a uniform temperature a uniform spin rate to thereby impart a constant angular velocity to the cup; and (4) applying a thin, uniform film of cooling medium to the cup tangential to the rotating cup surface whereby the relative velocity between the rotating cup and the applied film of water on the surface is approximately zero.

The same basic process steps according to the invention may also be used to create a high gloss surface on previously waxed flat webs or sheet stock. Again, the relative velocity of the flat coated wax surface and the cooling water film is at a minimum, preferably zero at the point of contact with the water.

In one exemplary embodiment, the process according to the invention maintains the wax temperature on the cup surface before cooling/gloss formation at approximately 160° F. with a cup spin rate of approximately 285 rpm. The preferred angular cup velocity falls in the range of 250–400 rpm depending on cup diameter. The water temperature is normally held at about 45° F., and the "narrow cut" paraffin wax used as the coating has an average melting point of 140° F., preferably in the range of 130° F. to 140° F.

Significantly, it has also been found that the available temperature "window" for applying the cooling/gloss step in accordance with the present invention may be as much as 40° F. above the wax melting point (rather than the 3 to 5 degree range available using conventional methods), depending on the wax composition. Because the cooling on the cup surface takes place without otherwise disturbing the liquid wax surface, the process offers a significantly greater degree of operating flexibility.

The process of cooling a cup with a film of water in accordance with the invention results in an average gloss surface reading of 68 as compared to double-sided poly cups which normally have a gloss surface reading of approximately 60 for readings taken on unprinted flat stock using a standard Photovolt Model 670 Reflection Meter.

It has also been found that the present method for producing a gloss surface on paper containers or sheet stock results in a product which is both bio-degradable and capable of being recycled. The underlying graphics are also equal to or better than those produced when using poly paper.

Other advantages of the invention include (1) the improved sealing capability of the wax cup as compared to double-sided poly cups; (2) improved sidewall stiffness; (3) a reduced cost of production (due to the use of a lower basis weight paper and a less costly coating material); and (4) high operating flexibility, i.e., commercially acceptable products produced within relatively broad ranges of operating conditions for the wax coating and cooling water temperatures.

Thus, it is an object of the present invention to produce a uniform high gloss on a previously wax-coated cup or sheet stock comparable to the presently available double-sided poly products, i.e., having equal or better characteristics of gloss, stiffness and graphic appearance.

It is still a further object of the present invention to produce a paper container or sheet stock having a high gloss surface which is capable of being recycled and which offers improved sealing characteristics as compared to double-sided poly articles.

It is still a further object of the present invention to produce a high gloss wax-coated cup or sheet stock more efficiently and economically than conventional double-sided poly articles.

These and other objects of the present invention will become more clear upon a review of the following examples, appended drawings and description of the preferred exemplary embodiment.

INFORMATION DISCLOSURE STATEMENT

The reader's attention is directed to the following prior art patents and printed publications:

| Inventor | U.S. Pat. No. | Date Issued |
|---|---|---|
| Fraenkel et al | 3,365,325 | January 23, 1968 |
| Schwenkler et al | 3,485,656 | December 23, 1969 |
| Labombarde | 3,202,532 | August 24, 1965 |
| Bauer et al | 3,192,893 | July 6, 1965 |
| Labombarde | Re. 25,792 | June 8, 1965 |
| Case et al | 3,177,091 | April 6, 1965 |
| Labombarde | 3,070,457 | December 25, 1962 |
| Cree | 2,732,319 | January 24, 1956 |
| Boenau | 2,999,765 | September 12, 1961 |
| Snader et al | 2,282,898 | May 12, 1942 |
| Mazee et al | 2,659,683 | November 17, 1953 |
| Decker et al | 1,385,042 | July 19, 1921 |
| Gage | 1,007,086 | October 31, 1911 |

The '325 patent to Fraenkel et al generally relates to an apparatus for depositing a curtain of falling liquid transverse to a wax coated sheet or web of moving material. Water is admitted into a trough at normal pressure through a conduit, penetrates through a porous member and departs along a sharp edge in a thin vertical curtain. The falling curtain of water impinges against the hot wax coated surface and administers a sudden chilling to the surface to produce the glossy appearance of the sheet material.

The '893 patent to Bauer et al relates to an apparatus for producing a highly glossed flat sheet. The patent discloses using coolant temperatures below the congealing temperature of the coating composition in a cooling water system whereby the water is pumped using a liquid conducting means and emerges through a manifold through a plurality of orifices spaced at intervals throughout the length of the manifold.

The '792 reissue patent to Labombarde teaches that a high gloss finish may be applied to blanks of paper delivering the blanks into a "quenching zone" which comprises an unbroken water fall of coolant liquid.

The '656 patent to Schwenkler et al concerns a method for treating paper board and includes the step of setting the wax by chilling it with cold water.

The '091 patent to Case et al concerns a method and apparatus for handling wax coated objects immediately after the wax has been applied but before it has solidified. The patent discloses the use of a continuous film of water to pass down and impact on the surface of a moving belt of wax coated materials.

The '765 patent to Boneau relates to a method for coating milk containers which includes cooling the mixture to a temperature below the "cloud point" of the mixture but above its melting point.

The '319 patent to Cree concerns a method for coating paper with a "thermoplastic material" to form a high gloss and discloses the use of a chilling tank and an apparatus which discharges a sheet or film of water upon one or both sides of the web in advance of the point of contact of the coated web with the water in the tank.

The '683 patent to Mazee et al concerns the application of a wax material to a web of paper followed by rapid cooling of the fiberous material using a mercury cooling bath.

The '898 patent to Snader et al discloses the use of a container bath having a relatively shallow body of fluid through which a coated paper web passes.

The '042 patent to Decker et al likewise discloses a method and apparatus for causing the coated paper to travel through a bath of heated wax followed by a water bath.

The '086 patent to Gage relates to a process for treating containers of fiberous materials and shows a method for chilling the waxed container using a cold air box and air flow, as opposed to a liquid dip.

DETAILED DESCRIPTION OF THE PRESENTLY PREFERRED EXEMPLARY EMBODIMENT

Figure 1:
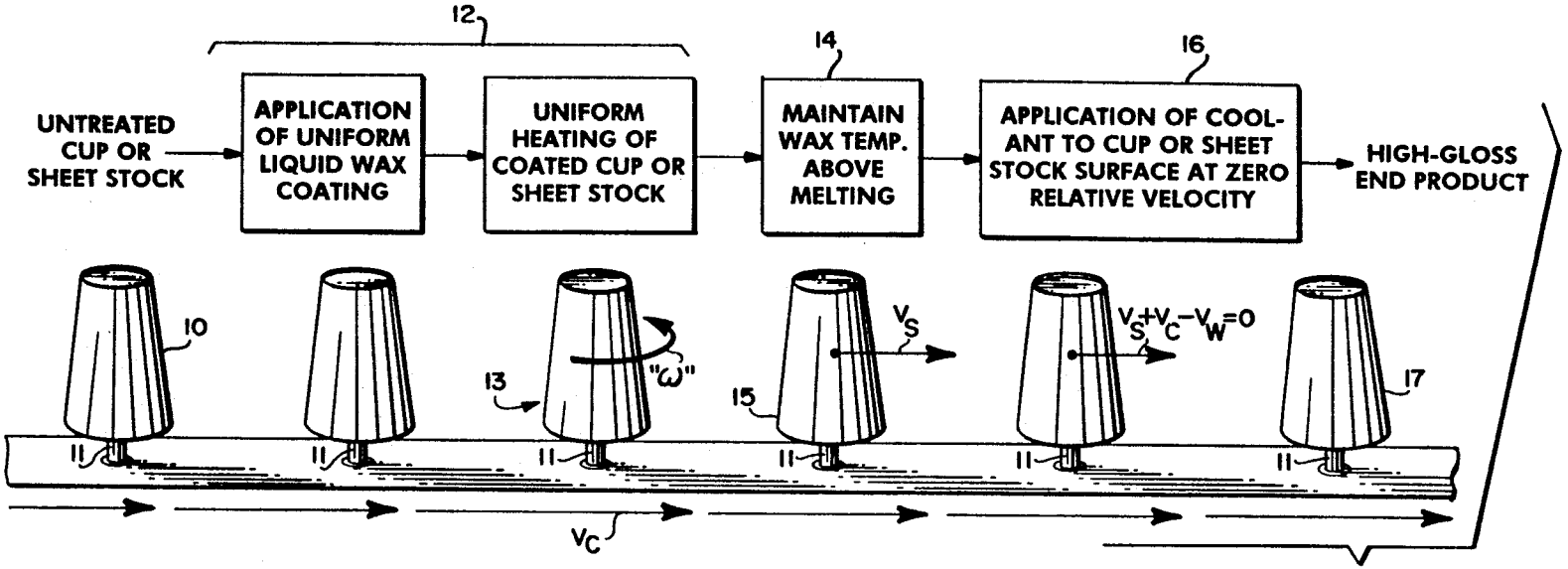
FIG. 1 contains a block flow diagram showing the basic process steps in accordance with the present invention as applied to untreated (unwaxed) sheet stock or cups and other containers, as well as a representation of an exemplary container undergoing the process steps.

FIG. 1 of the drawings depicts a block flow diagram together with figurative representations of an exemplary container undergoing the process steps in accordance with the present invention. As the block diagram of FIG. 1 makes clear, the present invention may be used for purposes of forming a high gloss on either a flat web of paper (sheet stock) or a wide variety of containers such as conventional wax-coated drinking cups and is equally applicable in both continuous or batch operations.

In a continuous process for producing a gloss surface, unwaxed cups (shown by way of example as item 10 on FIG. 1) are temporarily secured onto a continuously moving conveyor belt or drive chain in the usual manner by means of conventional cup holders 11. The cups pass through a wax treater unit 12 which typically comprises a plurality of spray nozzles (not shown) which apply a substantially uniform thin wax film to the outside surface of moving cup 10. Typically, the wax spray nozzles are fed by conduits connected to conventional melting, storage and piping means for the paraffin wax. As indicated above, for purposes of the present invention, it has been found that suitable wax coating blends useful with the present invention have preferred melting temperatures in the range of between 130° and 140° F. However, as those skilled in the art will appreciate, other wax coating blends may be acceptable, depending on the desired coating thickness, coolant/wax temperature differential and other process variables.

As the coated cup leaves the wax treater unit 12, the temperature of the wax coating is not permitted to drop below the congealing temperature. Thus, as the cup leaves the wax treater 12, the cup is rotated about its axis as shown at 13 at a constant spin rate "$\omega$", while maintaining the wax temperature above its melting point as shown at 14. The uniform rotation of the cup tends to distribute the liquid wax form uniformly along the outside surface 15 such that it remains as a thin film of wax having a substantially uniform thickness and temperature as it enters cooling zone 16.

Figure 2:
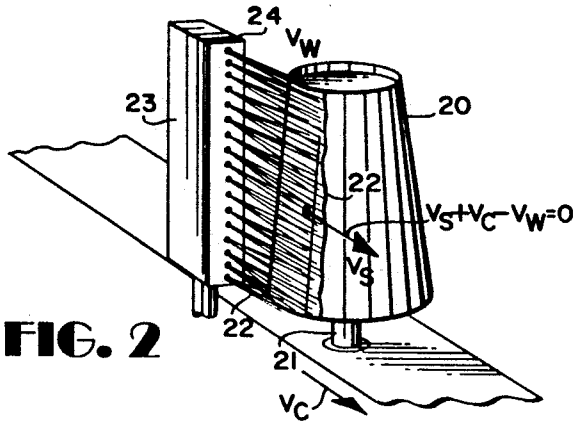
FIG. 2 is a detail of a cup depicted in FIG. 1 undergoing the cooling/gloss forming step during the process according to the present invention.

During the cooling step 16 depicted in FIG. 1, the cup continues to rotate at a constant spin rate "$\omega$", i.e., with a cosntant surface velocity $V_S$ as chilled water (or othe equivalent cooling means) is applied under laminar flow conditions substantially tangential to the outside surface of the cup and uniformly along its entire outside surface (item 20 on FIG. 2). As indicated above, in a continuous process, cup 10 is simultaneously moving horizontally on a conveyor at a constant linear velocity as shown by the arrow "$V_C$" on FIG. 1 and that a constant surface velocity $V_S$ such that the relative linear velocity of the cooling medium $V_W$ is as close to zero as possible relative to the linear velocity of the cup surface. The instantaneous cooling/crystallization effect during cooling at this zero relative velocity results in a high gloss finish 17 which is substantially uniform in nature.

After formation of the gloss, cup 10 passes out of cooling zone 16 into a drying section 37 (see FIG. 3) in which a drying medium, such as air in the form of an "air knife" (shown genrally as 38), is applied to the forward edge of moving cup 10, thereby removing excess water and drying the fully congealed wax surface. After drying, the finished cups may be removed using a conventional take-off conveyor means.

FIG. 2 of the drawings shows in greater detail the relationship between the velocity components for the cup, moving conveyor and coolant flow as described above. In one preferred embodiment of the subject invention, water is used as the coolant medium and passes through suitable conduit means and emerges from a manifold assembly having a plurality of small orifices spaced at substantially equal intervals along the length of the manifold. As those skilled in the art will appreciate, a wide variety of nozzle designs may be used as long as the end result is the emission of a thin curtain or film of coolant having substantially the same volume, termperature and linear velocity along the entire length of the nozzle manifold. In the exemplary embodiment of FIGS. 1 and 2, the nozzle is disposed substantially vertical and parallel to the moving line of treated cups.

In FIG. 2, cup 20 is moving in a horizontal direction at a constant linear velocity $V_C$ while rotating on a cup holder 21 at a constant spin rate and therefore at a constant surface velocity $V_S$. The cooling water 22 flows from manifold 23 through orifices 24 at a constant velocity $V_W$ and at an orientation which is substantially tangential to rotating cup 20. As indicated above, the water film 22 touches (but does not disturb) the wax coating, and tends to wrap around the entire cup forming a thin film water "envelope" at the moment of cooling/crystallization.

Figure 3:
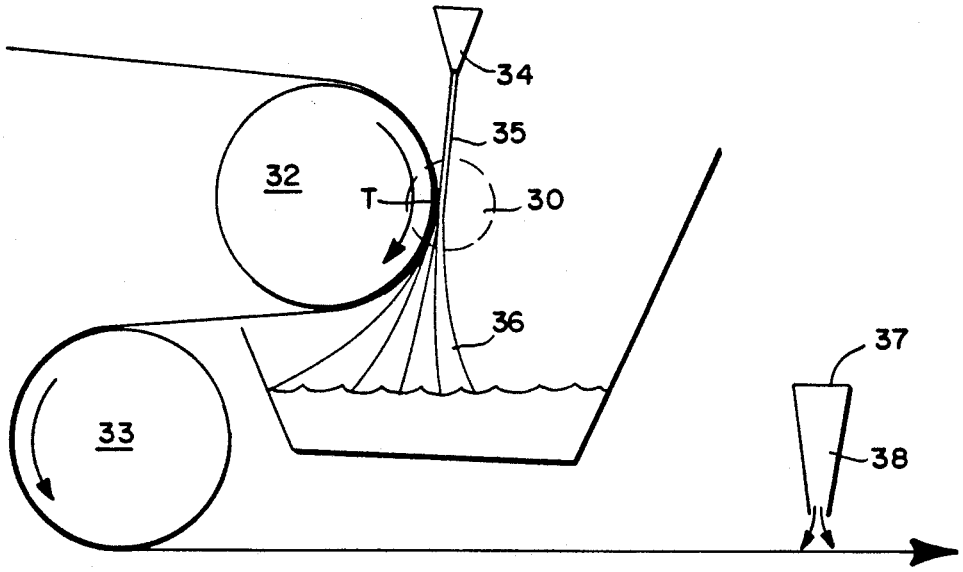
FIG. 3 is a process flow diagram showing the method for producing a gloss surface on a unwaxed paper sheet stock in accordance with the present invention.

FIG. 3 of the drawings schematically depicts the exemplary process steps described above as applied to a continuously moving flat web or sheet stock which has been previously coated with a thin wax coating. Flat sheet stock 31 is shown leaving the wax application stage whereby liquid wax has previously been applied as a continuous film across the entire top surface of web 31. The web is shown moving at a constant velocity $V_S$ and is preferably constructed from paperstock materials but may be any type of material requiring a wax coating thereon.

As the sheet stock 31 enters the cooling zone, it moves over a pair of driven rollers, 32 and 33, respectively, which form the sheet stock in a curvilinear manner, i.e., having the same radius of curvature as driven roller 32. During cooling/crystallization, water 36 from conduit system 34 is applied under laminar flow conditions in the form of thin uniform curtain 35 at point "T" on the moving sheet stock, i.e., substantially tangential to the web and across its entire width. Before the moving web reaches the second driven roller 33, the liquid wax on the sheet surface has congealed to instantaneously form a high gloss as a result of the applied coolant. Thereafter, sheet stock 31 is conveyed through the same drying and takeoff sections described above.

Figure 4:
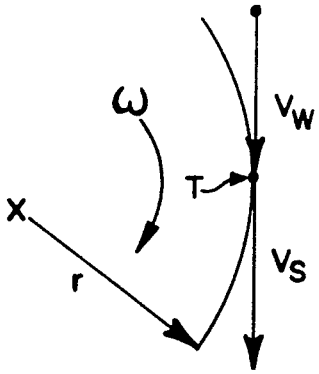
FIG. 4 is a diagram depicting an exemplary velocity profile for a cup undergoing the process steps in accordance with the present invention.

FIG. 4 of the drawings graphically depicts an exemplary velocity profile for the moving sheet stock and liquid coolant described above relative to FIGS. 1, 2, 3 and 4. Water traveling at velocity $V_W$ contacts the moving web surface at point "T" which is likewise moving at substantially the same velocity $V_S$ due to the rotation of drum 32. The linear velocity of the sheet stock surface at point "T" is the product of the rotational speed "$\omega$" of drum 32 and drum radius "r." Thus, as FIG. 4 illustrates, the preferred relative velocity of the coolant water to the web as it touches the moving web is equal to the difference between $V_S$ and $V_W$ and is preferably zero.

Figure 5:
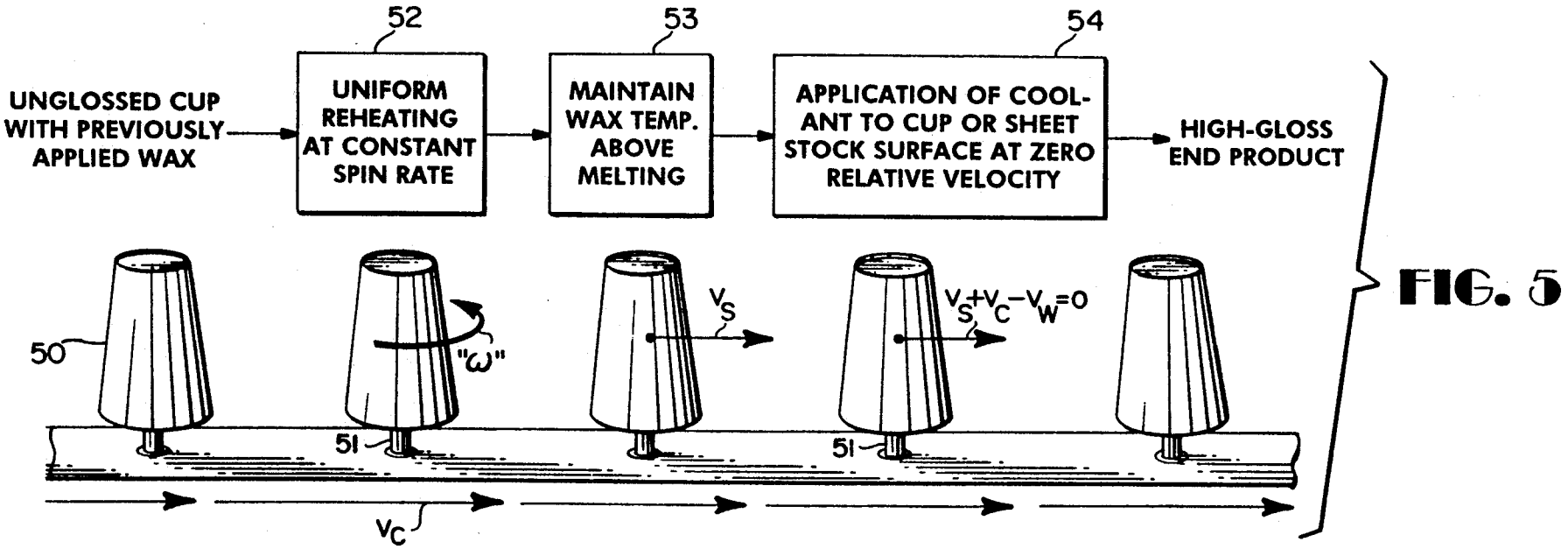
FIG. 5 contains a block flow diagram showing the basic process steps for an alternative embodiment of the present invention as applied to previously-waxed sheet stock or cups and other containers, as well as a representation of an exemplary container undergoing the process steps.

An alternative embodiment of the present invention is depicted in FIG. 5 in which previously waxed and cooled cups 50 (having congealed, non-gloss wax surfaces) may also be treated in accordance with the present invention to produce a uniform high gloss surface.

As FIG. 5 illustrates, waxed cups 50 are temporarily secured onto a continuously moving conveyor belt or drive chain in the usual manner by means of conventional cup holders 51. The cups pass through a reheating unit 52 which raises the temperature of the coated wax to a uniform temperature above its melting point while rotating cups 50 at a constant spin rate "$\omega$".

Significantly, it has been found that this uniform and carefully controlled reheating of the previously waxed cups serves to improve the uniformity of the coated article prior to the cooling step 54 which forms the gloss surface. Preferably, the reheating is accomplished using one or more infrared heaters (not shown) immediately upstream of the cooling/crystallization zone. During reheating, the cup is rotated about its axis at a constant spin rate "$\omega$" thereby imparting a constant surface velocity, while simultaneously being heated in the reheating zone 52. Again, this simultaneous rotation and heating with the wax temperature maintained above its melting point (as shown at 53) tends to make the previously applied wax film (now remelted) more uniform in nature, thereby improving the quality of the gloss finish which is thereafter applied using the chilling step described above. That is, during the time in which rotating cup 50 is within the reheating zone, the wax temperature increases above the melting point (and above its congealing temperature). As the cup rotates at constant velocity, the melted wax becomes more uniformly distributed along the outside surface and remains as a thin film of wax having a substantially uniform thickness and temperature as it enters cooling zone 54.

COMPARATIVE EXAMPLES

The following laboratory examples using bench model equipment further illustrate the preferred exemplary process according to the present invention.

An existing wax treater cup holder was used to spin wax cups in front of an infrared heater to simulate the condition of the cups coming off the end of a wax treater line. Three different cooling air/water methods were tested and the resulting cup surfaces examined and compared for gloss intensity and uniformity. All tests were conducted with the cup surface at 160° F. and the cup spinning at 285 rpm. For all tests, the wax used was 140° F. melting point, paraffin wax.

EXAMPLE 1

In this example, previously waxed spinning cups were heated as indicated above with respect to step 52 of FIG. 5. The cups were then conveyed through an air curtain at about 15° F. and cooled. The rate of heat transfer was insufficient to produce a gloss surface, while leaving the liquid wax undisturbed, resulting in unacceptably poor surface quality.

EXAMPLE 2

Previously waxed spinning cups were heated as indicated above. Water at 32° F. was then introduced to the interior of the cups and produced a gloss surface on the inside of the cups only. The rate of heat conduction through the sidewall of the cups was insufficient to effect the rapid rate of cooling on the exterior surface and no gloss surface was produced.

EXAMPLE 3

Previously waxed spinning cups were again treated as indicated above and moved through a water film held at 45 degrees Fahrenheit at approximately zero relative velocity and at an angle of orientation substantially tangential to the rotating cup surface. A uniform gloss surface of high quality resulted. The resulting gloss finishes were then measured using a standard Photovolt Model 670 Reflection Meter. The average resulting gloss reading was 68.

The above test results demonstrate that the application of water coolant at zero relative velocity to the hot waxed cups produces a uniform gloss surface. The examples also confirm that the film of water should be applied parallel to the cup sidewall and tangent to the outer diameter of the cup.

The process of cooling the cups with a film of water in accordance with the invention results in an average gloss surface reading of 68. In comparison, double-sided poly cups have an average gloss surface reading of about 60.

It has also been found that the colder the water, the better the gloss surface within a water temperature range of about 40° F. to 55° F. Thus, due to the heat transfer from cooling the wax, a chiller should normally be installed in the water system to maintain the desired low coolant temperatures.

While the invention herein has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A paper cup of the type having a smooth, high gloss coating and being produced by the method comprising the steps of:
   (a) applying a substantially uniform coating of melted wax material to at least the outside surface of said container;
   (b) maintaining the temperature of said wax coating at a temperature above its melting point;
   (c) imparting a constant angular velocity to said container; and
   (d) applying a substantially uniform thin film of liquid coolant to said outside surface of said container, said coolant having a linear velocity substantially equal to said absolute surface velocity of said container and being applied substantially tangential to said outside surface.

2. A paper cup of the type having a smooth, high gloss coating and being produced by the method comprising the steps of:
   (a) heating said paper container and said wax coating to a temperature above the congealing temperature of said wax for a time sufficient to cause said wax to form a uniform liquid film on said outside surface;
   (b) imparting a constant angular velocity to said container;
   (c) maintaining the temperature of said wax coating at a temperature above its melting point; and
   (d) applying a substantially uniform thin film of liquid coolant to said outside surface of said container, said coolant having a linear velocity substantially equal to said absolute surface velocity of said container and being applied substantially tangential to said outside surface.

3. A paper cup of the type having a smooth, high gloss coating formed on he outside surface thereof comprising:
   (a) a paper substrate formed in a truncated cone configuration to thereby define an outside surface portion thereof;
   (b) a substantially uniform coating of wax material applied to said outside surface of said cup; and
   (c) a substantially uniform film of liquid coolant overlaying and contacting said uniform layer of wax material, said coolant covering a portion of said outside surface of said cup during the formation of said smooth, high gloss coating.

4. A flat paper web of the type having a smooth, high gloss coating and being produced by the method comprising the steps of:
   (a) advancing said flat paper web along a horizontal path while applying a substantially uniform coating of melted wax material to the top surface thereof;
   (b) maintaining the temperature of said melted wax above the congealing point of said wax material for a time sufficient to cause said wax material to form a uniform liquid film across the top surface of said flat paper web;
   (c) imparting a constant linear velocity to said coated surface of said flat paper web; and
   (d) applying a substantially uniform thin film of lqiuid coolant to said coated surface of said flat paper web, said coolant having a linear velocity substantially equal to said linear velocity of said flat paper web and being applied substantially tangential to said coated surface.

5. A flat paper web of the type having a smooth, high gloss coating formed on the top surface thereof comprising:
   (a) a flat paper substrate;
   (b) a substantially uniform coating of wax material applied to said outside surface of said flat paper web; and
   (c) a substantially uniform film of liquid coolant overlaying and contacting said uniform layer of wax material, said coolant covering a portion of said outside surface of said flat paper web during the formation of said smooth, high gloss coating.

* * * * *